US008888553B2

(12) United States Patent
McMullen

(10) Patent No.: US 8,888,553 B2
(45) Date of Patent: Nov. 18, 2014

(54) DOLL HEAD HAVING A MAGNETICALLY ADJUSTABLE FACIAL CONTOUR AND METHOD OF ASSEMBLING SAME

(76) Inventor: Matthew McMullen, Oceanside, CA (US)

( * ) Notice: Subject to any disclaimer, the term of this patent is extended or adjusted under 35 U.S.C. 154(b) by 0 days.

(21) Appl. No.: 13/459,150

(22) Filed: Apr. 28, 2012

(65) Prior Publication Data

US 2013/0288565 A1 Oct. 31, 2013

(51) Int. Cl.

| | |
|---|---|
| ***A63H 3/12*** | (2006.01) |
| ***A63H 3/36*** | (2006.01) |
| *A63H 3/40* | (2006.01) |

(52) U.S. Cl.

CPC . *A63H 3/365* (2013.01); *A63H 3/40* (2013.01)
USPC ..... 446/321

(58) Field of Classification Search

USPC ..... 446/321
See application file for complete search history.

(56) References Cited

U.S. PATENT DOCUMENTS

| | | | | |
|---|---|---|---|---|
| 2,250,916 | A | | 7/1941 | Magruder |
| 2,465,971 | A | | 3/1949 | Leblany |
| 3,210,884 | A | | 10/1965 | Sharff et al. |
| 3,383,793 | A | | 5/1968 | Bonanno |
| 3,411,237 | A | | 11/1968 | Crosman |
| 3,464,146 | A | * | 9/1969 | McCurdy ..... 446/100 |
| 3,492,760 | A | | 2/1970 | Nishitani |
| 3,616,572 | A | | 11/1971 | Kosicki et al. |
| 3,830,012 | A | | 8/1974 | Franke |
| 4,798,556 | A | | 1/1989 | Vicars et al. |
| 5,071,385 | A | | 12/1991 | Cox |
| 5,092,811 | A | | 3/1992 | Bergenguer |
| 5,243,971 | A | * | 9/1993 | Sullivan et al. ..... 128/205.25 |
| 5,362,271 | A | | 11/1994 | Butt |
| 5,566,362 | A | * | 10/1996 | Bauer et al. ..... 455/90.3 |
| 5,862,615 | A | | 1/1999 | O'Rourke |

(Continued)

FOREIGN PATENT DOCUMENTS

| | | | |
|---|---|---|---|
| CN | 2807390 | Y | 8/2006 |
| CN | 28344650 | Y | 11/2006 |

(Continued)

OTHER PUBLICATIONS

WO1998003225 Morgan et al, 1998.*

(Continued)

*Primary Examiner* — Kurt Fernstrom
*Assistant Examiner* — Dolores Collins
(74) *Attorney, Agent, or Firm* — Russ Weinzimmer & Associates P.C.

(57) ABSTRACT

A doll head is disclosed having a magnetically adjustable facial contour, along with a method for assembling same. In one embodiment, the doll head includes a face mask support on which is mounted an elastically deformable face mask. Movable adjustment mechanisms and associated motors and power supplies for moving the adjustment mechanisms are disposed in the face mask support. Each adjustment mechanism generates an applied magnetic field. First magnets are affixed to an inner surface of the face mask, and second magnets in magnetic communication with the first magnets are slidably disposed on an exterior surface of the face mask support. The adjustment mechanisms selectively apply magnetic fields that slidably adjust position of the second magnets. As position of the second magnets slidably adjust, the first magnets move to a like extent. As the first magnets move, contour of the face mask adjusts to change expression of the doll head.

20 Claims, 15 Drawing Sheets

(56) References Cited

U.S. PATENT DOCUMENTS

| | | | | |
|---|---|---|---|---|
| 5,941,750 | A | 8/1999 | Pracas | |
| 6,112,746 | A * | 9/2000 | Kwok et al. | 128/207.13 |
| 6,119,693 | A * | 9/2000 | Kwok et al. | 128/207.11 |
| 6,357,441 | B1 * | 3/2002 | Kwok et al. | 128/207.13 |
| 6,685,530 | B1 | 2/2004 | Rehkemper et al. | |
| 6,729,930 | B1 | 5/2004 | Lui | |
| 6,758,717 | B1 * | 7/2004 | Park et al. | 446/391 |
| 6,776,683 | B1 | 8/2004 | Lin | |
| 6,945,841 | B2 | 9/2005 | Becker et al. | |
| 7,325,996 | B2 | 2/2008 | Varner et al. | |
| 7,524,231 | B2 | 4/2009 | Matheny et al. | |
| 7,743,767 | B2 * | 6/2010 | Ging et al. | 128/206.24 |
| 8,184,097 | B1 * | 5/2012 | Barney et al. | 345/158 |
| 8,371,302 | B2 * | 2/2013 | Ging et al. | 128/206.24 |
| 8,373,659 | B2 * | 2/2013 | Barney et al. | 345/158 |
| 2004/0161732 | A1 * | 8/2004 | Stump et al. | 434/262 |
| 2004/0197764 | A1 * | 10/2004 | Stump et al. | 434/433 |
| 2007/0149091 | A1 | 6/2007 | Viohl | |
| 2013/0207441 | A1 * | 8/2013 | Morrissey | 297/468 |
| 2013/0317346 | A1 * | 11/2013 | Alagappan et al. | 600/415 |

FOREIGN PATENT DOCUMENTS

| | | | |
|---|---|---|---|
| CN | 2897361 | Y | 5/2007 |
| CN | 21049207 | Y | 4/2008 |
| ES | 2063674 | | 1/1995 |
| GB | 2011264 | A | 7/1979 |
| GB | 2196545 | A | 5/1988 |
| JP | 08289937 | A | 11/1996 |
| JP | 10146464 | A | 6/1998 |
| JP | 200311030 | A | 11/2003 |
| JP | 2004121498 | A | 4/2004 |
| JP | 2006167390 | A | 12/2004 |
| JP | 2005110889 | A | 4/2005 |
| JP | 2006167390 | A | 6/2006 |
| JP | 2006341065 | A2 | 12/2006 |
| JP | 2007202935 | A | 8/2007 |
| JP | 2008113962 | | 5/2008 |
| KR | 3085249 | A | 11/2003 |

OTHER PUBLICATIONS

Google Search Result # 1 Website Link <Oct. 11, 2009>: http://www.tias.com/13/PictPage/1923007848.html.

Google Search Result # 2 Website Link <Oct. 11, 2009>: http://www.dollreference.com/effanbee_dolls.html.

Google Search Result # 3 Website Link <Oct. 11, 2009>: http://justsomerandomdude.deviantart.com/art/Custom-Captain-Falcon-Figure-107856150.

Google Search Result # 4 Website Link <Oct. 11, 2009>: http://www.scarletstarstudios.com/blog/archives/2009/02/coraline_puppet_technology_with_photos.html.

* cited by examiner

DOLL HEAD HAVING A MAGNETICALLY ADJUSTABLE FACIAL CONTOUR AND METHOD OF ASSEMBLING SAME

FIELD OF THE INVENTION

This invention generally relates to doll heads and more particularly relates to doll heads having an adjustable facial contour.

BACKGROUND OF THE INVENTION

Dolls have many uses, such as play toys for children, prizes at amusement parks, figures at religious ceremonies, mannequins in department stores, decoration in homes and businesses, anatomically correct figures to train doctors and nurses, collectors' items and other uses.

A doll, such as in the form of a full-sized mannequin or smaller children's toy, will include a doll head. The doll head typically possesses features of a human or animal. Often, however, the facial features of the doll head are static and immobile. That is, the facial expression of the doll head is invariable and cannot readily change to express joy, surprise, amazement, confusion, anger, fear and other emotions. Such static doll head designs rarely retain the user's interest.

In an effort to retain the user's interest, some doll head designs have interchangeable parts, such as hair and lips, so as to change the appearance of the doll head. However, these interchangeable parts are cumbersome and time-consuming to deploy because the parts must first be removed and then exchanged with other parts.

In addition, some prior art doll head designs do not suitably exhibit life-like attributes, such as realistic eye movement. For example, in the case of some children's dolls, the entire doll must be moved in order for the doll to move its eyes between an open position and a closed position. That is, in the case of some children's dolls, the entire doll must be moved to a reclined position for the doll's eyes to fully close and moved to an upright position for the doll's eyes to fully open. Thus, such a child's doll depends on gravity to move both eyes of the doll between the open and closed positions. In addition, such a doll head cannot laterally move its eyes from side-to-side to simulate following an object or person moving, for example, across a room. Absence of emotion and life-like movement detract from the user's enjoyment of the doll.

Moreover, such prior art dolls lack independently operable facial features. For example, in the case of the previously mentioned child's doll, the doll's eyes are not independently movable because they open and close together. In this case, the doll's eyes do not move independently to simulate, for example, winking. In addition, such dolls lack an ability to dynamically contort or change a region of the doll's face independently of another region of the doll's face to simulate, for example, a smile or frown.

Attempts have been made to provide dolls with life-like features. For example, a full size, fully articulated doll with selectively displayed alternative faces in the form of an adult human female is provided in the prior art. The alternative faces are provided by exchanging face masks or heads. A flexible resilient material inclusive of silicone rubber is used for simulated skin for the face. The alternatively selected faces enable variation of appearance inclusive of both expression and genotype. However, the expression evinced by each selected face mask or head is static and, thus, immobile.

Another attempt provides a doll form that includes a body and head in the general shape of a human or animal. The head includes a facial portion comprised of a first support having a receiving surface for receiving a face member. The face member is made of a second support having a transfer surface for transfer of facial features having the likeness of a particular person or animal. The face member can be removed and changed with another face member having different facial features. Other exchangeable accessories, including hair and clothing, are used to customize the doll to become anyone so desired. However, the expression of each face member is static and, thus, immobile.

According to another approach, a doll head with replaceable features is provided, wherein the head has a mouth recess in which a pair of lips is inserted. A magnet, which is secured to the back wall of the recess, magnetically grips a ferromagnetic plate bonded or otherwise secured to the rear of the pair of lips. Replaceable ears, wigs, eyebrows, eyes and noses may be held in place on the doll head by a magnet secured to the inner surfaces of the wall of the doll's face at several socket locations. Although this approach discloses use of magnets, changes in the doll's facial expression is apparently only achieved by replacing lips, ears, wigs, eyebrows, eyes and noses. Thus, after these components are replaced, the doll's facial expression remains static and, thus, immobile.

According to yet another approach, a doll's eye is provided with magnetic means for opening and closing of the doll's eye. In this regard, a simulated doll's eye is pivotally arranged on a horizontal axis within a housing, the housing being accommodated within a doll's head. The eye carries a magnet, the magnetic axis being perpendicular to a pivot axis so that a separate control magnet can cause eye movement. The control magnet may be an external permanent magnet or an internal solenoid. However, this approach apparently only controls eye movement and does not address magnetically controlling movement of facial features. Thus, although the doll's eye movement is controlled by use of a magnet, the doll's facial expression remains static and, thus, immobile.

SUMMARY OF THE INVENTION

The present invention provides a doll head having a magnetically adjustable facial contour and a method of assembling same.

The doll head includes a rigid face mask support to which a flexibly resilient face mask is securely mounted. The face mask support is made of a solid material, such as a polymer plastic, epoxy, wood, or light-weight metal. The face mask is made of an elastically deformable or flexible material, such as rubber or other elastic material. The face mask defines a facial contour that may have human features, such as a mouth, lips, nose, eye openings, eye brows, cheeks, chin, and ears. Alternatively, the face mask may define a facial contour of an animal, such as a dog, or an entirely imaginary fanciful creature, such as a space alien.

Attached, such as by a suitable adhesive, to an inside surface of the face mask are a plurality of attached first magnets. An outside or exterior surface of the face mask support includes a plurality of movable second magnets. The first magnets and second magnets are positioned such that, when the face mask is mounted on the face mask support, the first magnets and the second magnets are substantially aligned opposite each other and contact each other. In other words, the first magnets and the second magnets are arranged in pairs, so that each first magnet is paired or assigned to a corresponding second magnet. The first magnets and second magnets possess opposite polarity, so that each pair of first magnets and second magnets magnetically connect to each other. In this manner, the first and second magnets detachably secure the face mask to the face mask support. Alternatively, a magnetically responsive plate member, rather than a magnet, may be substituted either for the first magnet or the second magnet, if desired.

In accordance with one embodiment, the face mask support defines a plurality of slots therethrough for slidably receiving respective ones of the plurality of second magnets. The face mask support also defines a cavity therein, in which is disposed a plurality of adjustment mechanisms magnetically coupled to respective ones of the plurality of second magnets. In this regard, the adjustment mechanism may be a solenoid capable of generating a magnetic field. The adjustment mechanism is adapted to reorient or move the magnetic field. In this manner, each adjustment mechanism is adapted to selectively cause each second magnet to slide in its respective slot due to reorientation or movement of the electric field. As the second magnet slides in its respective slot, the corresponding first magnet moves to a like extent because the first and second magnets are magnetically coupled, as mentioned hereinabove. As the first magnet moves, a corresponding portion or region of the flexibly resilient face mask also moves, so that the facial contour of the face mask changes. A plurality of electrically operable motors powered by a power source, which may comprise at least one battery, operates the adjustment mechanisms.

In addition, the face mask support includes a pair of eye sockets that have a pair of eye elements respectively disposed therein. Each eye element includes a magnetically responsive portion thereof that is in magnetic communication with a corresponding adjustment mechanism disposed within the cavity defined by the face mask support. The adjustment mechanism includes a pair of solenoids aligned with respective ones of the pair of eye elements. Each solenoid is capable of independently or separately generating a magnetic field. The adjustment mechanism is adapted to reorient or move the magnetic fields. In this manner, each adjustment mechanism is adapted to selectively cause each eye element to move in in its respective eye socket due to reorientation or movement of the electric fields. That is, as the magnetically responsive portion of the eye element moves, the eye element itself moves to a like extent. The eye element moves, such as vertically (i.e., up and down) and horizontally (i.e., side-to-side), in the eye socket as the as the magnetic fields move. Moreover, the face mask support includes a mechanically or magnetically operated jaw assembly that is movable between an open position and a closed position for respectively opening and closing the doll's mouth and lips.

The prior art mentioned hereinabove appears to disclose doll heads that can have alternative faces only by exchanging face masks or heads, and only by exchanging doll face members. The prior art mentioned hereinabove also appears to disclose typical doll heads having eyes that open and close only when the entire doll is moved or eyes that are operable only by mechanical means rather than primarily magnetic means. Also the prior art mentioned hereinabove does not appear to disclose use of magnetic means for causing the doll's eyes to wink. The invention described and claimed herein addresses these and other limitations of the prior art.

According to an aspect of the present invention, there is provided a doll head having a magnetically adjustable facial contour, including: a face mask support; a face mask mountable on the face mask support, the face mask being movable from a first facial contour to a second facial contour thereof; a first magnet connectable to the face mask; and a second magnet adjustably connectable to the face mask support, the second magnet being adapted to magnetically couple to the first magnet for moving the first magnet as the second magnet is adjusted, whereby the face mask moves from the first facial contour to the second facial contour thereof as the first magnet moves.

According to another aspect of the present invention, there is provided a doll head having a magnetically adjustable facial contour, including: a rigid face mask support defining a cavity therein and a slot therethrough; a face mask mounted on the face mask support, the face mask being movable from a first facial contour to a second facial contour thereof, the face mask having an interior surface; a first magnet affixed to the interior surface of the face mask; and a second magnet adjustably received in the slot and magnetically coupled to the first magnet, whereby the first magnet moves as the second magnet magnetically couples to the first magnet and is adjusted and whereby the face mask moves from the first facial contour to the second facial contour thereof as the first magnet moves.

According to yet another aspect of the present invention there is provided a method of assembling a doll head having a magnetically adjustable facial contour, including: providing a face mask support; mounting a face mask on the face mask support, the face mask being movable from a first facial contour to a second facial contour thereof, the face mask having a first magnet connected thereto; and adjustably connecting a second magnet to the face mask support, the second magnet being adapted to magnetically couple to the first magnet for moving the first magnet as the second magnet is adjusted, whereby the face mask is movable from the first facial contour to the second facial contour thereof as the first magnet moves.

A feature of the present invention is the provision of a face mask mountable on a rigid face mask support, the face mask being movable from a first facial contour to a second facial contour thereof.

Another feature of the present invention is the provision of a first magnet attached to an interior surface of the face mask.

An additional feature of the present invention is the provision of a second magnet movably connected to the face mask support and in magnetic communication with the first magnet, so that the first magnet moves as the second magnet moves for adjusting (i.e., changing) a region of the face mask.

Still another feature of the present invention is the provision of an adjustment mechanism disposed in a cavity defined by the face mask support and coupled to the second magnet for moving the second magnet.

Yet another feature of the present invention is the provision of an electrically operated motor disposed in the cavity defined by the face mask support and connected to the adjustment mechanism for operating the adjustment mechanism.

A further feature of the present invention is the provision of a pair of eye elements movably disposed in a respective pair of eye sockets formed in the face mask support, the eye elements being magnetically movable.

In addition to the foregoing, various other method and/or device aspects and features are set forth and described in the teachings, such as text (e.g., claims and/or detailed description) and/or drawings of the present invention.

The foregoing is a summary and thus may contain simplifications, generalizations, inclusions, and/or omissions of detail. Consequently, those skilled in the art will appreciate that the summary is illustrative only and is not intended to be in any way limiting. In addition to the illustrative aspects, embodiments, and features described hereinabove, further aspects, embodiments, and features will become apparent by reference to the drawings and the following detailed description.

BRIEF DESCRIPTION OF THE DRAWINGS

The invention will be more fully understood by reference to the detailed description in conjunction with the following figures, wherein.

DETAILED DESCRIPTION OF PREFERRED EMBODIMENTS

Figure 1:
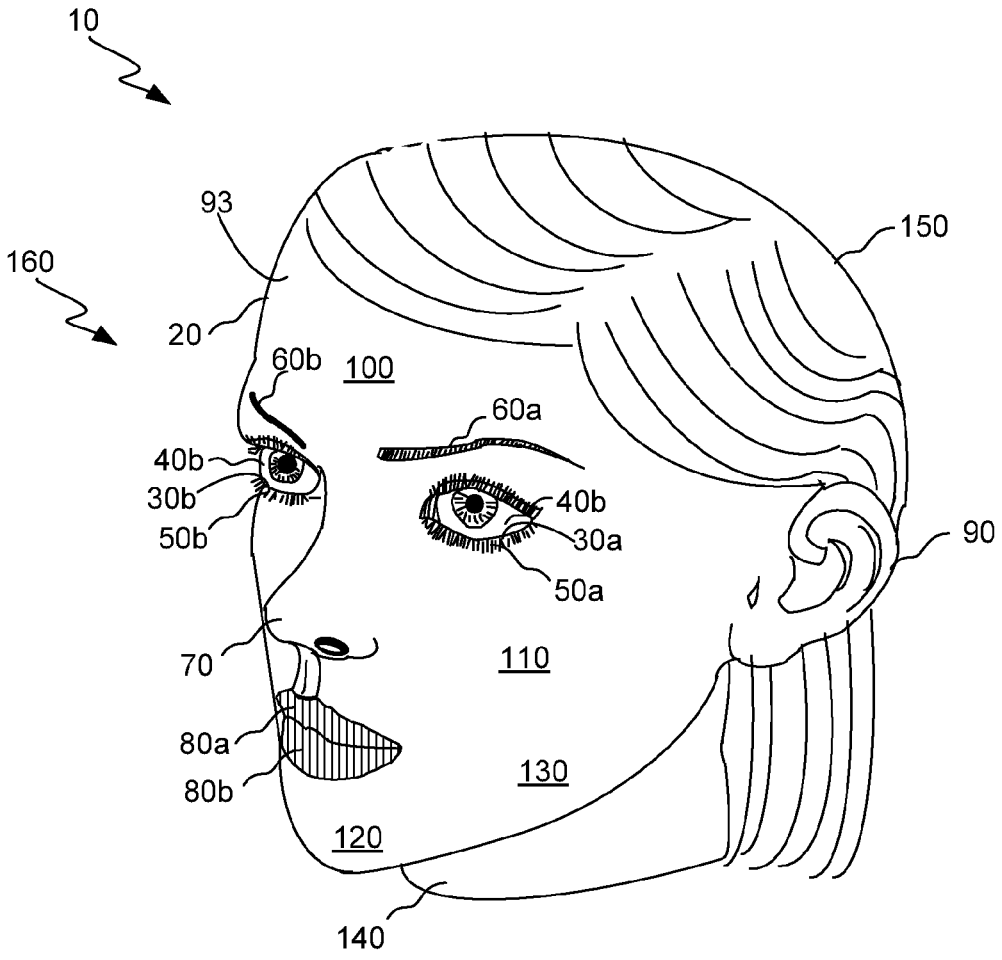
FIG. 1 is a view in perspective of a first embodiment doll head having a first facial contour.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from either the spirit or scope of the invention.

In addition, the present patent specification uses formal outline headings for clarity of presentation. However, it is to be understood that the outline headings are for presentation purposes, and that different types of subject matter may be discussed throughout the application (e.g., device(s)/structure(s) may be described under process(es)/operations heading(s) and/or process(es)/operations may be discussed under structure(s)/process(es) headings; and/or descriptions of single topics may span two or more topic headings). Hence, the use of the formal outline headings is not intended to be in any way limiting.

Therefore, with reference to FIG. 1, there is shown a first embodiment doll head, generally referred to as 10. First embodiment doll head 10, which can simulate a human head, includes a flesh colored first embodiment face mask 20 having a pair of spaced-apart eye openings 30*a* and 30*b* for accommodating a corresponding pair of movable eye elements 40*a* and 40*b*, as described in more detail hereinbelow. Surrounding the pair of eye openings 30*a* and 30*b* and attached to first embodiment face mask 20 is a respective pair of eye lashes 50*a* and 50*b*. A pair of spaced-apart eye brows 60*a* and 60*b*, which is attached to first embodiment face mask 20, is associated with and disposed above their respective pair of eye openings 30*a* and 30*b*. First embodiment face mask 20 further includes a nose 70 and a pair of separable lips 80*a* and 80*b*. In addition, first embodiment face mask 20 includes a pair of ears 90 (only one of which is shown), an exterior surface 93 and an interior surface 96 (see FIG. 3). Interior surface 96 defines an interior volume 98 of first embodiment face mask 20 for purposes provided hereinbelow.

As shown in FIG. 1, first embodiment face mask 20 defines an elastically deformable forehead region 100, two elastically deformable cheek regions 110 (only one of which is shown), an elastically deformable chin region 120 and an elastically deformable jaw region 130. First embodiment face mask 20 may also include a neck portion 140 disposed below and integrally formed with jaw region 130. First embodiment doll head 10 may further include a wig 150, which is removably connected to first embodiment face mask 20. The shape of eye openings 30*a*/30*b*, nose 70, lips 80*a*/80*b*, forehead region 100, cheek regions 110, chin region 120 and jaw region 130 and the texture of wig 150, in addition to the color of first embodiment face mask 20, are chosen to simulate any one of a plurality of human genotypes.

Referring again to FIG. 1, and as previously mentioned, first embodiment face mask 20 is elastically deformable. In this regard, first embodiment face mask 20 is made of a relatively thin gauge resilient, flexible or elastomeric (i.e., rubber-like) deformable material, such as natural latex, synthetic latex (i.e., styro butane rubber), silicone rubber, or other suitable elastomeric material. In the case of natural latex, the natural latex material may comprise polymerized isoprene. Also, in the case of synthetic latex, the synthetic latex material may comprise polymerized monomers including isoprene, butadiene, chloroprene and/or isobutylene. In the case of silicone rubber, the silicone rubber may be a tin-catalyzed, condensation cured (i.e., cured in a controlled humidity environment) composition. More specifically, the composition of the silicon rubber may comprise suitable proportions of silicon, carbon, hydrogen and oxygen. Alternatively, "medical grade" or platinum-catalyzed silicon, which is less susceptible to tears, compression marks and shrinkage compared to tin-catalyzed silicon rubber, may be used as the material comprising first embodiment face mask 20. In this case, the medical grade or platinum-catalyzed silicon is non-toxic and compliant with U.S. Food and Drug Administration Class VI certification standards. Either in the form of tin-catalyzed or platinum-catalyzed silicon, silicon rubber can be beneficially used for first embodiment face mask 20 because silicon rubber is odorless, tasteless, reduces risk of staining and corroding other materials that may contact first embodiment face mask 20 and does not support bacteria growth. Although silicon rubber may be more expensive than latex, silicon rubber may be preferred over latex for use as a material for first embodiment face mask 20 for the reasons recited hereinabove and because latex may cause an allergic reaction in some individuals.

Referring yet again to FIG. 1, and for reasons provided hereinbelow, the elastomeric material comprising first embodiment face mask 20 should be durable as well as flexible or elastic. In this regard, by way of example only and not by way of limitation, first embodiment face mask 20 may possess an average thickness of approximately 25 gauge or 0.55 millimeter (0.021653 inch). Also, by way of example only and not by way of limitation, the latex or silicon elastomer comprising first embodiment face mask 20 should have a relatively high tear strength (e.g., approximately 250 pounds per square inch), high tensile strength (approximately 1,500 pounds per square inch), reasonable elongation (e.g., approximately 1,250% before permanent deformation occurs), low compression and a durometer range of between approximately five and approximately 80 as measured by the well-known Shore A hardness test.

Again referring to FIG. 1, eyelashes 50*a*/50*b* and eyebrows 60*a*/60*b* may be secured in-place by a suitable non-toxic adhesive, such as a non-toxic rubber adhesive. Eyelashes 50*a*/50*b*, eyebrows 60*a*/60*b* and wig 150 may comprise human hair, animal hair (e.g., horse hair) or a non-toxic synthetic fiber simulating human hair, such as an acrylic or a polyester synthetic fiber. Alternatively, eyelashes 50*a/b*, eyebrows 60*a/b* and wig 150 may be painted on first embodiment face mask 20 rather than being disposed on first embodiment face mask 20 as actual human hair, animal hair or synthetic fiber.

Figure 2:
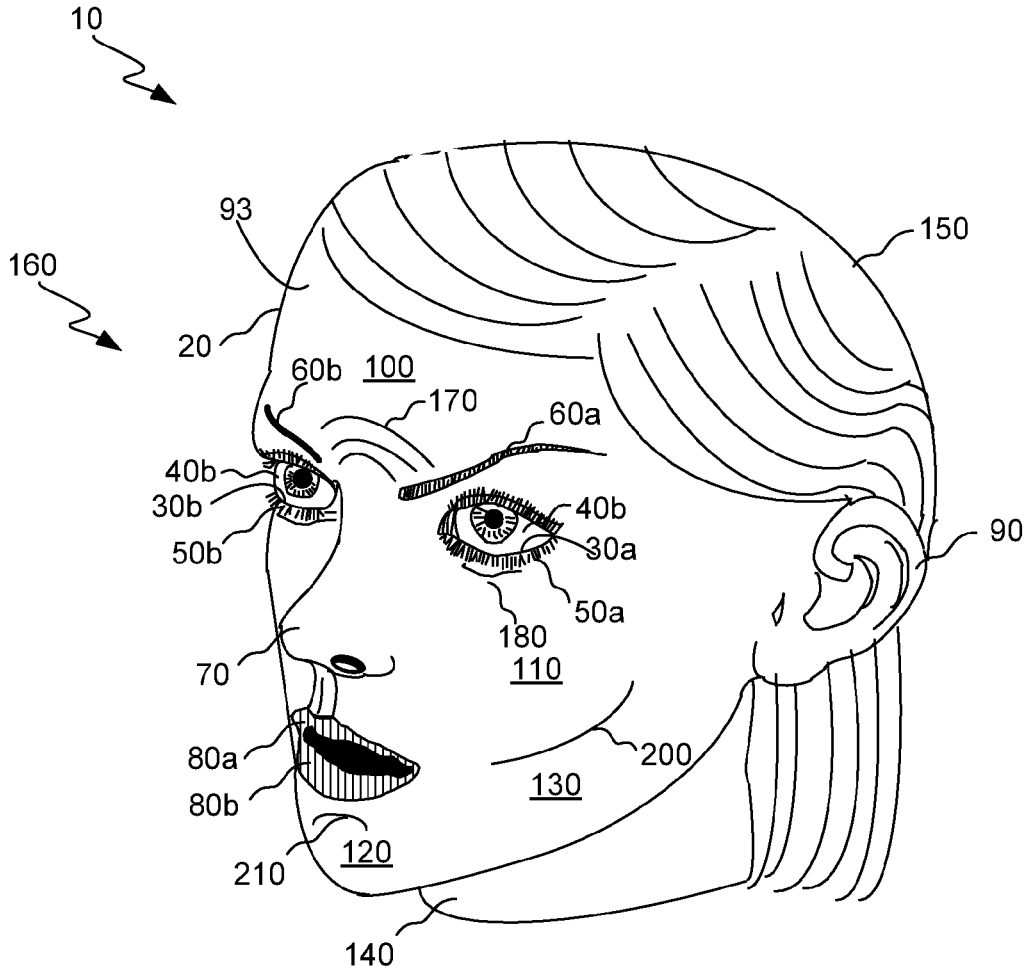
FIG. 2 is a view in perspective of the first embodiment doll head having a magnetically adjusted second facial contour.

Referring now to FIGS. 1 and 2, first embodiment face mask 20 is adapted to elastically move, deform or stretch from a first facial contour, generally referred to as 160, to a second facial contour, generally referred to as 170. Elastic movement, deformation or stretching of first embodiment face mask 20 is achieved by means disclosed in detail hereinbelow. First facial contour 160 and second facial contour 170 may be selected to simulate a plurality human expressions and emotions. For example, first facial contour 160 may simulate attentiveness and second facial contour 170 may simulate anger, as shown. Thus, in this example, the expression of first embodiment doll head 10 changes from attentiveness to anger. Other human-like expressions or emotions capable of being exhibited by first embodiment face mask 20 are also possible, such as pleasure, surprise, puzzlement, fear, happiness, and sadness. It may be appreciated that alteration of any of the human-like expressions caused by controlled elastic deformation of first embodiment face mask 20 may necessarily result in creation of a plurality of wrinkles in first embodiment face mask 20 in order to enhance realistic display of human-like expression or emotion. For example, the aforesaid elastic deformation may cause brow wrinkles 180 in forehead region 100, eye wrinkles 190 near eye openings 30*a*/30*b*, cheek wrinkles 200 in cheek region 110 and chin wrinkles 210 in chin region 120. In addition, controlled elastic deformation of first embodiment face mask 20 can cause lips 80*a*/80*b* to separate, so that lips 80*a*/80*b* move from a closed position to an open position, as shown. Hence, as previously mentioned, controlled elastic deformation of first embodiment face mask 20 allows movement of first embodiment face mask 20 from first facial contour 160 to second facial contour 170. Therefore, such controlled elastic deformation of first embodiment face mask 20 transforms expression of first embodiment doll head 10. The controlled elastic deformation of first embodiment face mask 20 is achieved by means described in detail hereinbelow.

Figure 3:
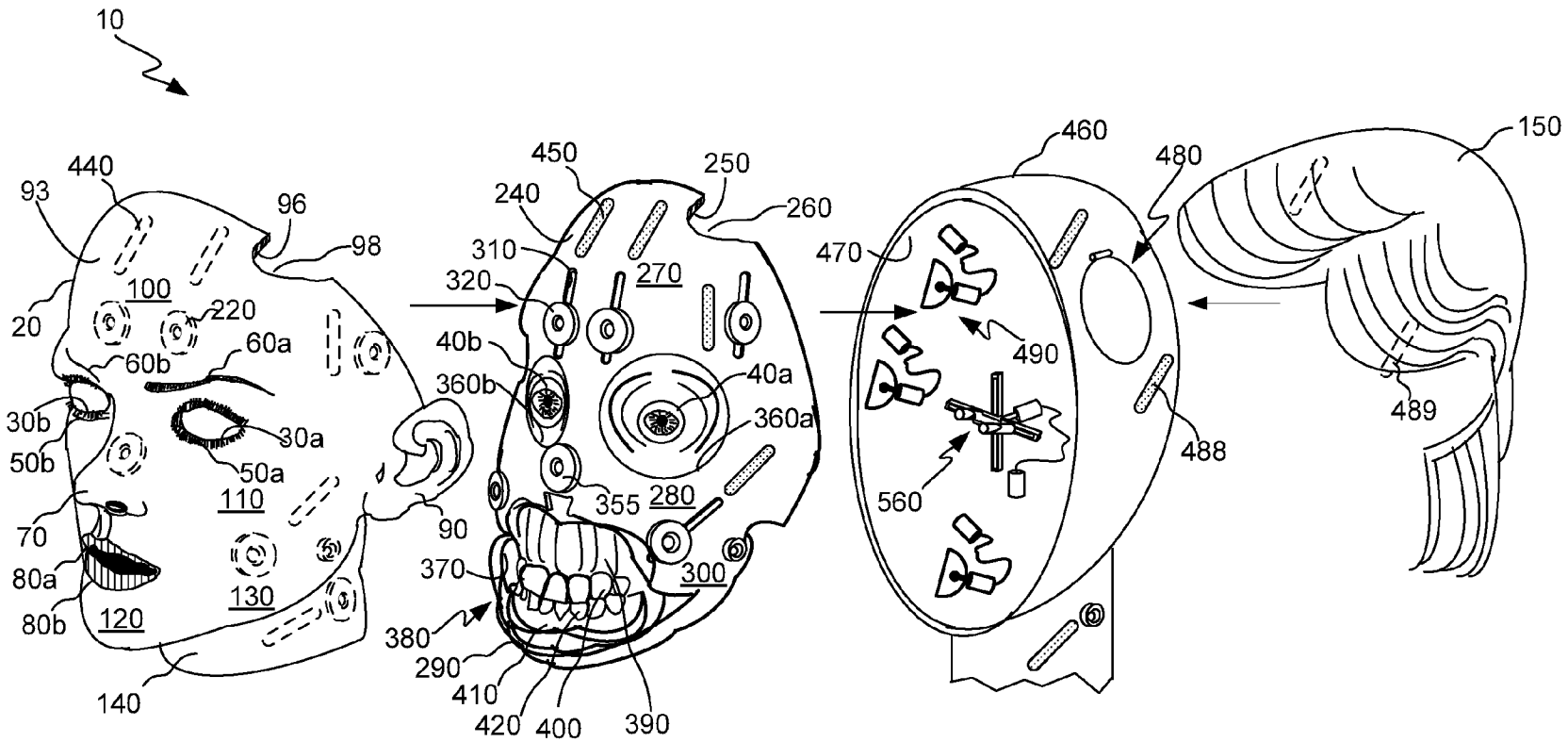
FIG. 3 is an exploded view of the first embodiment doll head.
Figure 4:
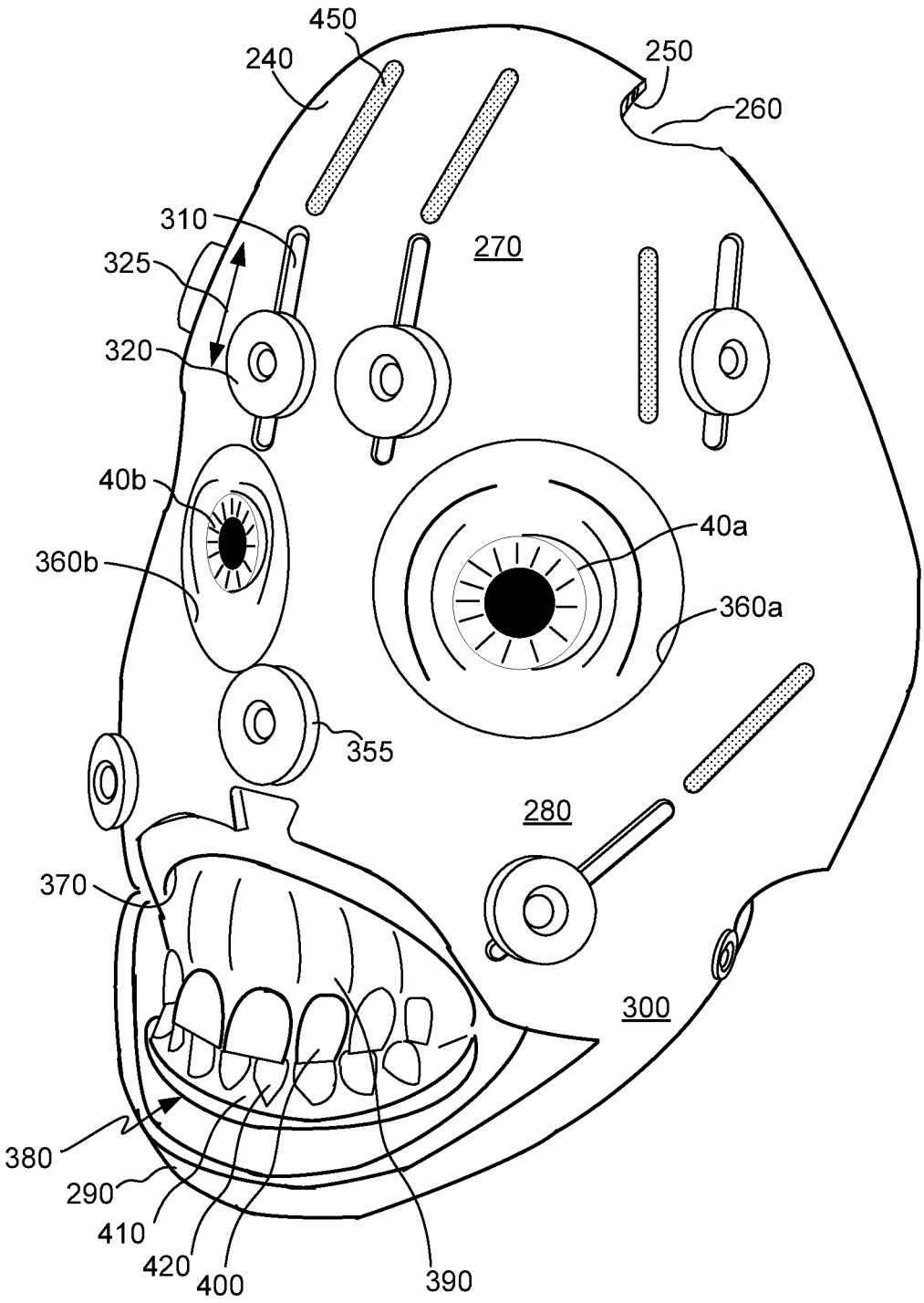
FIG. 4 is a view in perspective of a rigid face mask support for receiving a face mask belonging to the first embodiment doll head, the face mask support defining a cavity therein.
Figure 5:
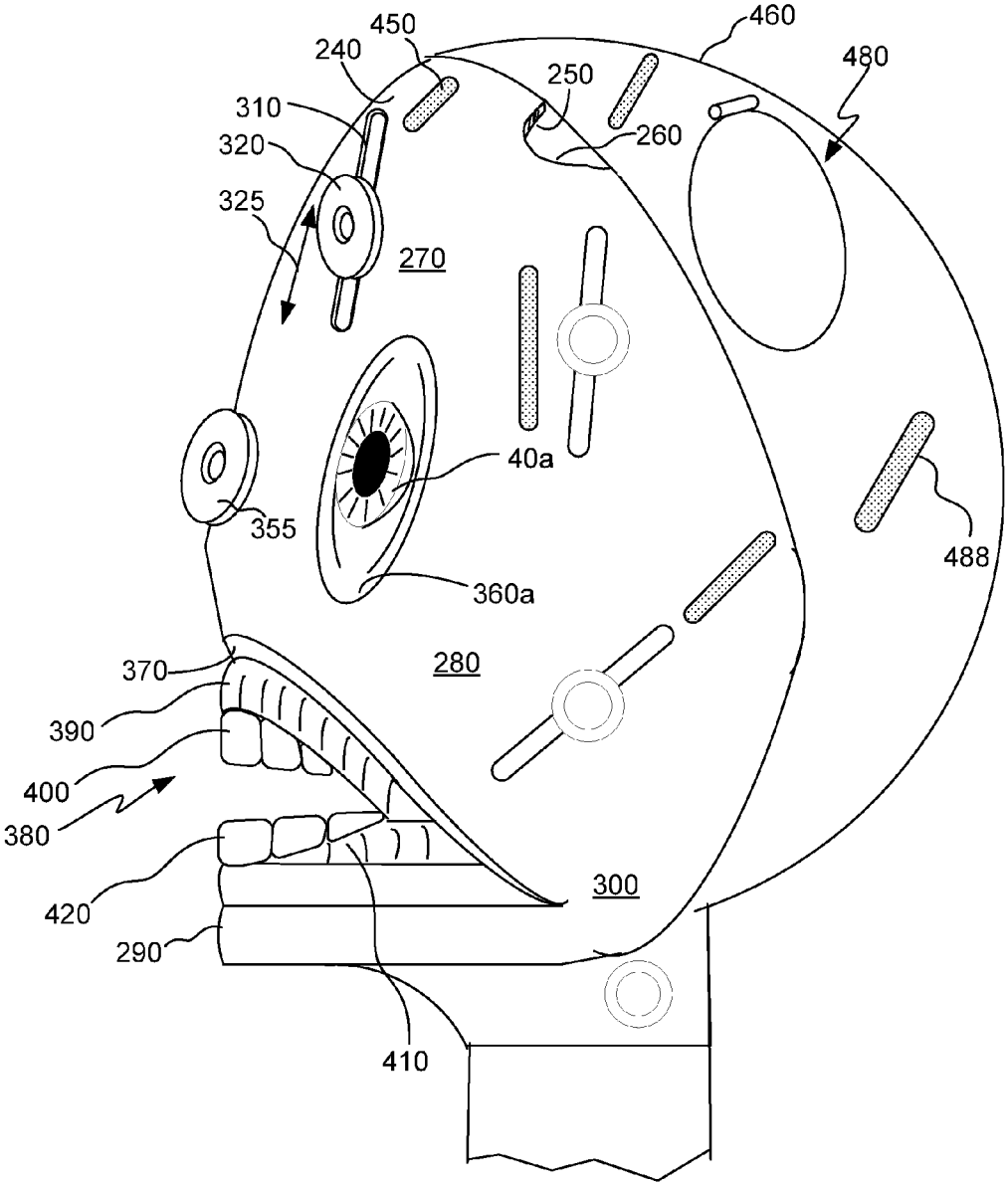
FIG. 5 is a view in elevation of the face mask support.
Figure 6:
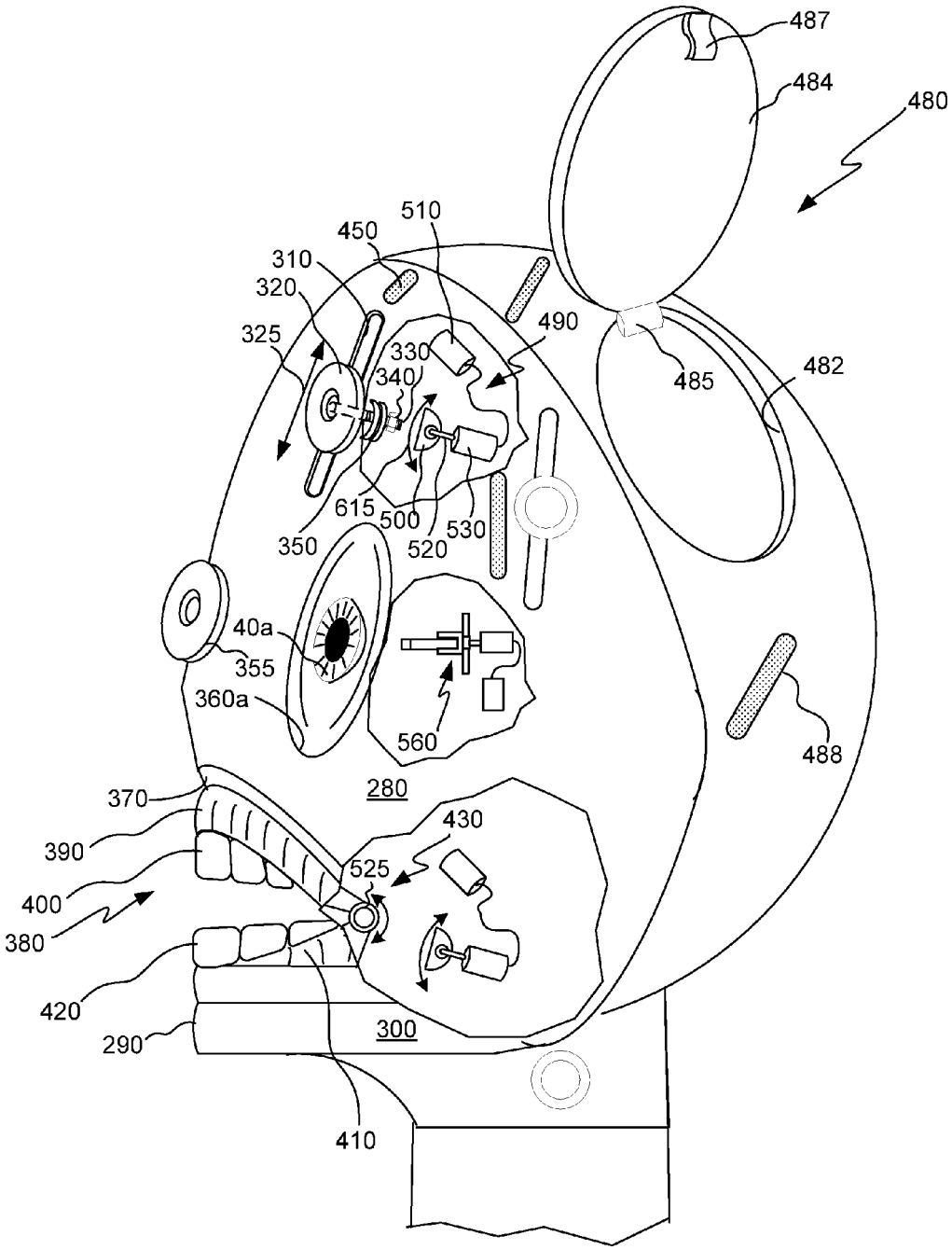
FIG. 6 is a view in elevation, with parts removed for clarity, showing a plurality of first embodiment adjustment mechanisms, motors and batteries disposed in the cavity defined by the face mask support, a selected one of the first embodiment adjustment mechanisms being magnetically coupled to a jaw assembly for moving the jaw assembly.
Figure 7:
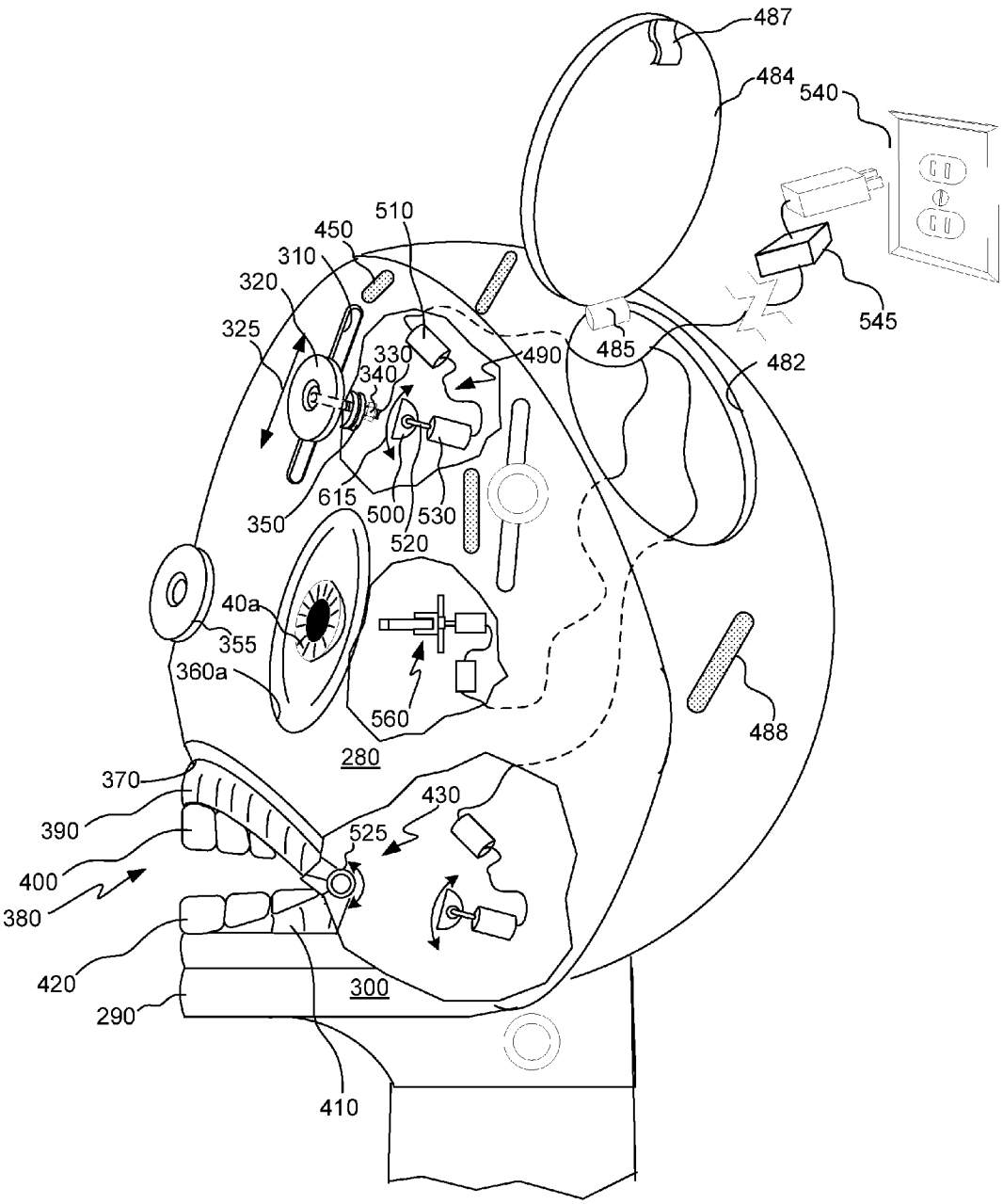
FIG. 7 is a view in elevation, with parts removed for clarity, showing a plurality of the first embodiment adjustment mechanisms, motors and rechargeable batteries disposed in the cavity defined by the face mask support, the rechargeable batteries being connectable to a power supply, such as an electrical wall outlet.
Figure 8:
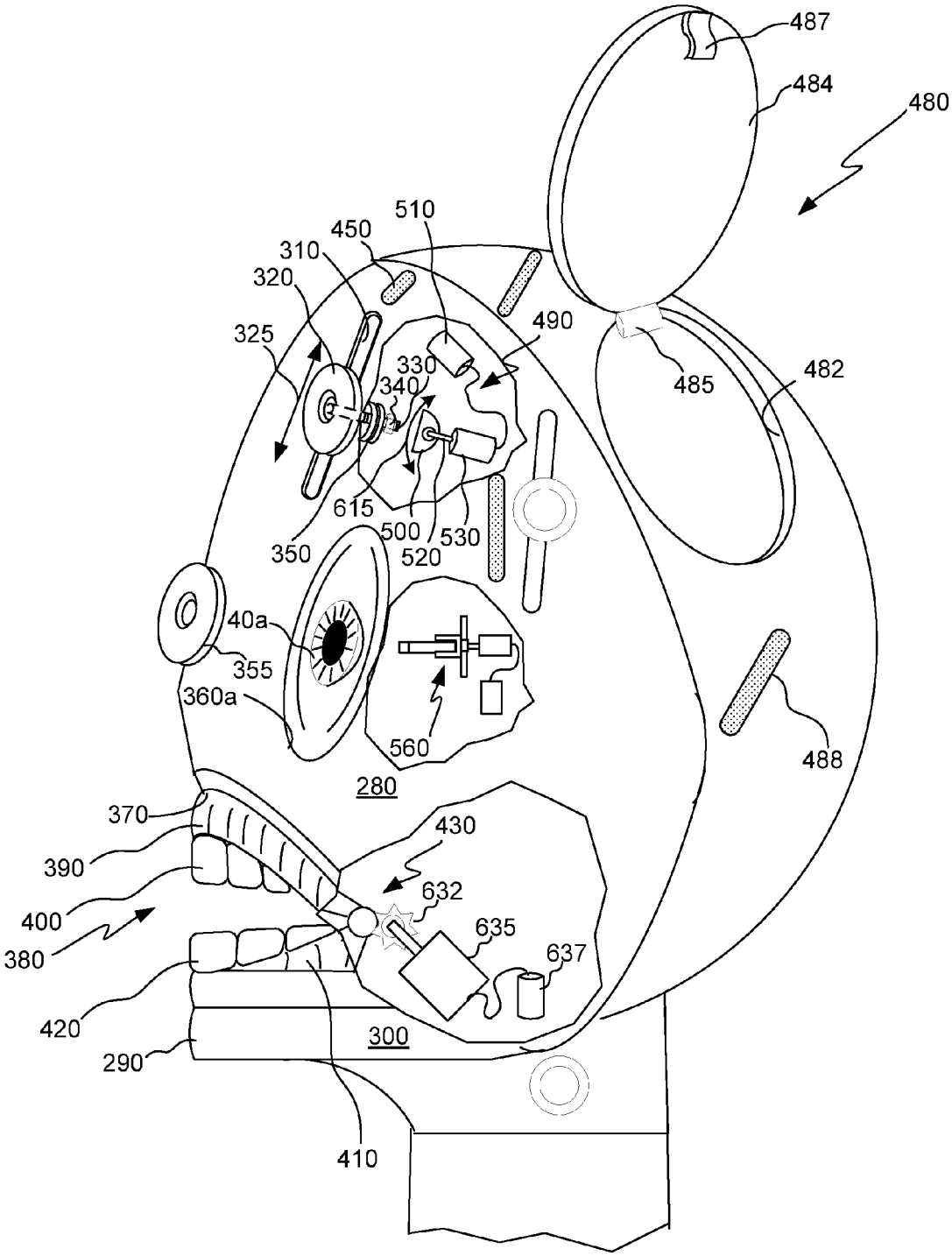
FIG. 8 is a view in elevation, with parts removed for clarity, showing the plurality of first embodiment adjustment mechanisms, motors and batteries disposed in the cavity defined by the face mask support, this view also showing an adjustment mechanism mechanically engaging the jaw assembly for moving the jaw assembly.
Figure 9:
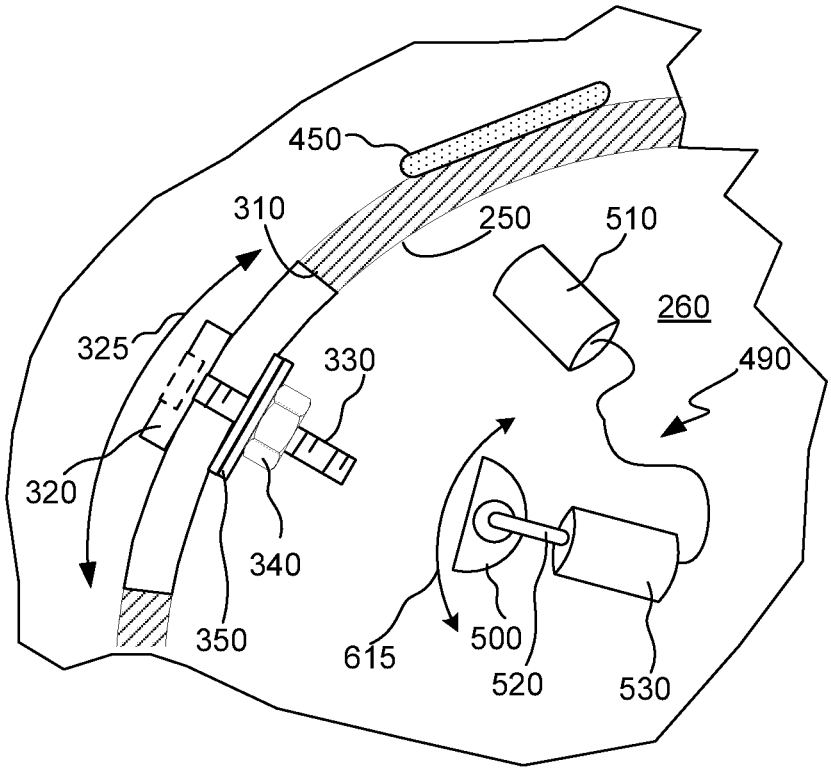
FIG. 9 is a fragmentary view, with parts removed for clarity, showing an exemplary one of the adjustment mechanisms disposed in the cavity defined by the face mask support, the exemplary one of the adjustment mechanisms being in magnetic communication with a respective one of the second magnets for moving the second magnet.

Referring to FIGS. 3, 4 and 5, means for achieving controlled elastic deformation of first embodiment face mask 20 will now be described. In this regard, a plurality of first permanent magnets 220 are attached to interior surface 96 of first embodiment face mask 20. First permanent magnets 220 are affixed to interior surface 96 by any suitable means, such as by use of a suitable adhesive. The adhesive may be a rubber adhesive, if desired. More specifically, each of first permanent magnets 220 is disposed at a predetermined location on interior surface 96. The predetermined location is selected so as to be where elastic deformation of first embodiment face mask 20 is desired in order to transform the first facial contour 160 to the second facial contour 170. For example, there is at least one first permanent magnet 220 disposed near each of forehead region 100, cheek region 110 and lips 80*a*/80*b*. There may be any number of first permanent magnets 220 disposed at various predetermined locations on inside surface 96 depending on the desired complexity and detail of expression to be displayed by first embodiment face mask 20 when first facial contour 160 is transformed into second facial contour 170. Based on the teachings herein, it may be appreciated by a person of ordinary skill in the art of doll design that portions of first embodiment face mask 20 will move as any of first permanent magnets 220 moves in order to vary the facial expression of first embodiment doll head 10.

Referring again to FIGS. 3, 4 and 5, first embodiment face mask 20 is mountable on a rigid first embodiment face mask support, generally referred to as 230. First embodiment face mask support 230 is configured or shaped to be matingly received in previously mentioned interior volume 98 that is defined by interior surface 96 of first embodiment face mask 20. Therefore, a purpose for interior volume 98 is to matingly receive first embodiment face mask support 230 therein. First embodiment face mask support 230 is durable as well as rigid. In this regard, first embodiment face mask support 230 is formed from a high-impact durable material, such as a polymer plastic, epoxy, wood or light-weight metal in order to withstand normal handling by a user of first embodiment doll head 10. First embodiment face mask support 230 includes an exterior surface 240 and an interior surface 250. Interior surface 250 of first embodiment face mask support 230 defines an interior space 260 for purposes provided hereinbelow.

Referring yet again to FIGS. 3, 4 and 5, first embodiment face mask support 230 supports first embodiment face mask 20 thereon when first embodiment face mask 20 is mounted on first embodiment face mask support 230. For example, first embodiment face mask support 230 includes a forehead portion 270, two cheek portions 280 (only one of which is shown), a chin portion 290 and a jaw portion 300 for respectively supporting the corresponding forehead region 100, cheek regions 110, chin region 120 and jaw region 130 of first embodiment face mask 20. First embodiment face mask support 230 defines a plurality of slots 310 therethrough for reasons disclosed momentarily. Predetermined ones of slots 310 may be linear or any desired shape. In this regard, predetermined ones of slots 310 may be shaped to curve in an arc (not shown) or an "S" shape (also not shown) or any curvilinear shape depending on the desired facial expression to be obtained. For example, each of a pair of slots 310 may be located on opposite sides of lips 80*a*/80*b* to effect a smile or frown.

Referring again to FIGS. 3, 4 and 5, a plurality of second permanent magnets 320, which possess an opposite polarity to that of first permanent magnets 220, are connected to first embodiment face mask support 230. First permanent magnets 220 are disposed on interior surface 96 of first embodiment face mask 20 and second permanent magnets 320 are disposed on exterior surface 240 of first embodiment face mask support 230 such that when first embodiment face mask 20 is mounted on first embodiment face mask support 230, first permanent magnets 220 and second permanent magnets 320 are brought into substantial alignment and contact with each other. First permanent magnets 220 and second permanent magnets 320 possess opposite polarity for establishing an attractive magnetic force between first permanent magnets 220 and second permanent magnets 320. In a manner described in detail momentarily, the attractive magnetic force established between first permanent magnets 220 and second permanent magnets 320 serves a dual purpose. First, when first permanent magnets 220 and second permanent magnets 320 contact each other, the attractive magnetic force between them causes first permanent magnets 220 and second permanent magnets 320 to connect to each other. In this manner, first embodiment face mask 20 is securely mounted on first embodiment face mask support 230 because magnets 220/320 are magnetically connected to each other. First embodiment face mask 20 can be removed from first embodiment face mask support 230, when desired, by manually exerting sufficient force to overcome the magnetic attraction and thereby separate first permanent magnets 220 and second permanent magnets 320. The ability to connect and separate first permanent magnets 220 and second permanent magnets 320 in this manner allows first embodiment face mask 20 to be removably mounted on first embodiment face mask support 230. Secondly, the attractive magnetic force allows first embodiment face mask 20 to be transformed from the previously mentioned first facial contour 160 to second facial contour 170 (see FIGS. 1 and 2), as described in detail hereinbelow.

Referring to FIGS. 3, 4, 5 and 6, use of first permanent magnets 220 and second permanent magnets 320 to transform the previously mentioned first facial contour 160 to second facial contour 170 will now be described. In this regard, predetermined ones of second permanent magnets 320 are slidably disposed in respective ones of slots 310. In this manner, individual ones of second permanent magnets 320 are adjustably connected to first embodiment face mask support 230 because second permanent magnets 320 are capable of adjusting by sliding in their respective slots 310, such as along directional arrow 325. However, second permanent magnets 320 should be retained in their respective slots 310, so that second permanent magnets 320 do not fall away or separate from first embodiment face mask support 230. Therefore, second permanent magnet 320 is slidably secured in slot 310 by means described presently. In this regard, second permanent magnet 320 includes an outwardly projecting, externally threaded post 330 that extends through slot 310. An internally threaded nut 340 is threadably received on post 330 and tightened against interior surface 250 of first embodiment face mask support 230. However, nut 340 is not tightened to an extent that prevents sliding movement of second permanent magnet 320 in slot 310. Rather, nut 340 is tightened only to an extent that allows second permanent magnet 320 to be connected to first embodiment face mask support 230 while simultaneously allowing second permanent magnet to slide in slot 310. In this manner, second permanent magnet 320 will not become detached from first embodiment face mask support 230 as second permanent magnet 320 slides in slot 310. In addition, if desired, at least one washer 350 may be interposed between nut 340 and interior surface 250 for evenly distributing pressure of nut 340 over the portion of interior surface 250 where nut 340 is located. Evenly distributing pressure of nut 340 over the portion of interior surface 250 where nut 340 is located prevents damage to interior surface 250. It may be appreciated that not all of second permanent magnets 320 need be movable. For example, if desired, at least one of the second permanent magnets, such as second permanent magnet 355, may be fixed or stationary on exterior surface 240 of first embodiment face mask support 230, as shown. A purpose of such fixed or stationary second permanent magnets 355 would be merely to removably connect first embodiment face mask 20 to first embodiment face mask support 230 and not to cause movement in first embodiment face mask 20. Such fixed or stationary second permanent magnets 355 are affixed to first embodiment face mask support 230 by any suitable means, such as by the previously mentioned post 330, nut 340 and washer combination that can be securely tightened against interior surface 250 or by means of a suitable adhesive (e.g., rubber adhesive).

Referring again to FIGS. 3, 4, 5 and 6, first embodiment face mask support 230 defines a pair of spaced-apart eye sockets 360*a* and 360*b* for receiving respective ones of the previously mentioned eye elements 40*a* and 40*b*. The eye elements 40*a*/40*b* and eye sockets 360*a*/360*b* are aligned with previously mentioned eye openings 30*a*/30*b* that are formed in first embodiment face mask 20 when first embodiment face mask is mounted on first embodiment face mask support 230. Movement of eye elements 40*a*/40*b* is magnetically controllable, as described hereinbelow. Moreover, first embodiment face mask support 230 further defines an opening 370 for display of dentures, generally referred to as 380. Dentures 380 include an upper simulated gingival 490 having upper simulated teeth 500 and a lower simulated gingival 510 having lower simulated teeth 520. Upper simulated gingival 490 is adapted to pivot about a pivot pin 525 that interconnects upper simulated gingival 490 and lower simulated gingival 510 in a hinge-like fashion. Dentures 380 belong to a magnetically or mechanically operable jaw assembly, generally referred to as 430, which is disposed in interior volume 260 that is defined by first embodiment face mask support 230. Jaw assembly 430 is capable of moving between an open position and a closed position, as described in more detail hereinbelow.

As best seen in FIG. 3, if desired, additional assurance may be provided that first embodiment face mask 20 can be securely mounted upon, but readily removed from, first embodiment face mask support 230. In this regard, a plurality of first fasteners 440 may be affixed to interior surface 96 of first embodiment face mask 20. In addition, a plurality of second fasteners 450 may be affixed to exterior surface 240 of first embodiment face mask support 230. Each of the plurality of first fasteners 440 is associated with a respective one of the plurality of second fasteners 450, so as to define pairs of oppositely disposed fasteners 440/450 when first embodiment face mask 20 is mounted on first embodiment face mask support 230. More specifically, fasteners 440/450 may be hook-and-loop fasteners. In this regard, such a hook-and-loop fastener 440/450 may be a "VELCRO® brand" hook-and-loop fastener, which may comprise a fabric made of Teflon®, nylon, polyester or other suitable material. "VELCRO® brand" is a registered mark of Velcro USA, Incorporated located in Manchester, N.H., USA. Teflon® is a registered mark owned by E.I. du Pont de Nemours and Company located in Wilmington, Del., U.S.A. Due to their hook-and-loop construction, such VELCRO® brand fasteners 440/340 may be in the shape of elongate strips that will engage each other when brought into contact and disengage each other when pulled apart. As previously mentioned, magnetic coupling of first permanent magnets 220 and second permanent magnets 320 allow first embodiment face mask 20 to be securely mounted upon, but readily removed from, first embodiment face mask support 230, However, fasteners 440/450 provide additional assurance that first embodiment face mask 20 can be securely mounted upon, but readily removed from, first embodiment face mask support 230.

Referring to FIGS. 3, 6, 7 and 8, first embodiment face mask support 230 is configured to be attached to a rear skull portion 460. The rear skull portion 460 defines a cavity 470 that is bounded or enclosed by rear skull portion 460 and first embodiment face mask support 230 when first embodiment face mask support 230 is attached to rear skull portion 460. First embodiment face mask support 230 may be attached to rear skull portion 460 by any suitable means, such as by rubber adhesive. Rear skull portion 460 includes a hatch assembly, generally referred to as 480, to allow access to cavity 470 for reasons disclosed momentarily. Hatch assembly 480 includes a hatch opening 482 formed in rear skull portion 460 and a hatch lid 484 for opening and closing hatch opening 482. A hatch hinge 485 is disposed near hatch opening 482 and connects hatch lid 484 to rear skull portion 460. In this manner, hatch hinge 485 allows manual opening and closing of hatch opening 482 while hatch lid 484 remains connected to rear skull portion 460. A locking member 487, such as a flexible tab, is connected to hatch lid 484. Locking member 487 flexibly engages a perimeter of hatch opening 482 for locking hatch lid 484 to rear skull portion 460 as hatch opening 482 is manually closed and for unlocking hatch lid 484 from rear skull portion 460 as hatch opening 482 is manually opened. Moreover, a plurality of third fasteners 488 coupled to first embodiment face mask support 230 and a plurality of fourth fasteners 489 coupled to an inner portion of wig 150 may be provided for removably attaching wig 150 to rear skull portion 460.

Referring to FIGS. 3, 6, 7, 8 and 9, disposed in cavity 470 are a plurality of first embodiment adjustment mechanisms, generally referred to as 490, for magnetically moving or adjusting respective ones of the plurality of second permanent magnets 320. It may be appreciated that moving or adjusting any of second permanent magnets 320 causes second magnet 320 to slide in its respective slot 310. First embodiment adjustment mechanism 490 includes a solenoid 500 capable of generating a magnetic field when electricity is supplied to solenoid 500. A power supply, such as a battery 510, is connected to solenoid 500 for supplying electricity to solenoid 500. Battery 510 may be a disposable battery that is periodically replaced when electrical energy has been drained therefrom due to use. If battery 510 is a disposable battery, then the battery 510 may be composed of any one of well-known non-rechargeable, disposable battery materials, such as an alkaline composition. If battery 510 is rechargeable, the battery 510 may be composed of any one of well-known rechargeable battery materials, such as Nickel-Cadmium (NiCd), Nickel-Metal Hydride (NiMH) or Lithium-Ion ($Li^+$). Recharging battery 510 is accomplished by connecting battery 510 to a power source, such as an electrical wall outlet 540 and adaptor 545, Access to battery 510 for replacing or recharging battery 510 is obtained by means of hatch assembly 480.

Referring again to FIGS. 3, 6, 7, 8 and 9, solenoid 500 is attached to a pivot arm 520 for moving or pivoting solenoid 500, such as along a directional arrow 515. The pivoting of solenoid 500 causes the magnetic field generated thereby to move or pivot. Movement or pivoting of the magnetic field generated by solenoid 500 causes second permanent magnet 320 to slidably move in slot 310 because second permanent magnet 320 is magnetically coupled to solenoid 500 due to the magnetic field generated by solenoid 500. An electrically operable motor 530 is connected to pivot arm 520 for moving or pivoting pivot arm 520. Previously mentioned battery 510 is also electrically connected to motor 530 for operating motor 530. The motor 530 may be controlled by means of a user-operated controller (not shown) connected thereto and disposed in cavity 470. Alternatively, the controller that is connected to motor 530 may be located externally to cavity 470, if desired.

Figure 10:
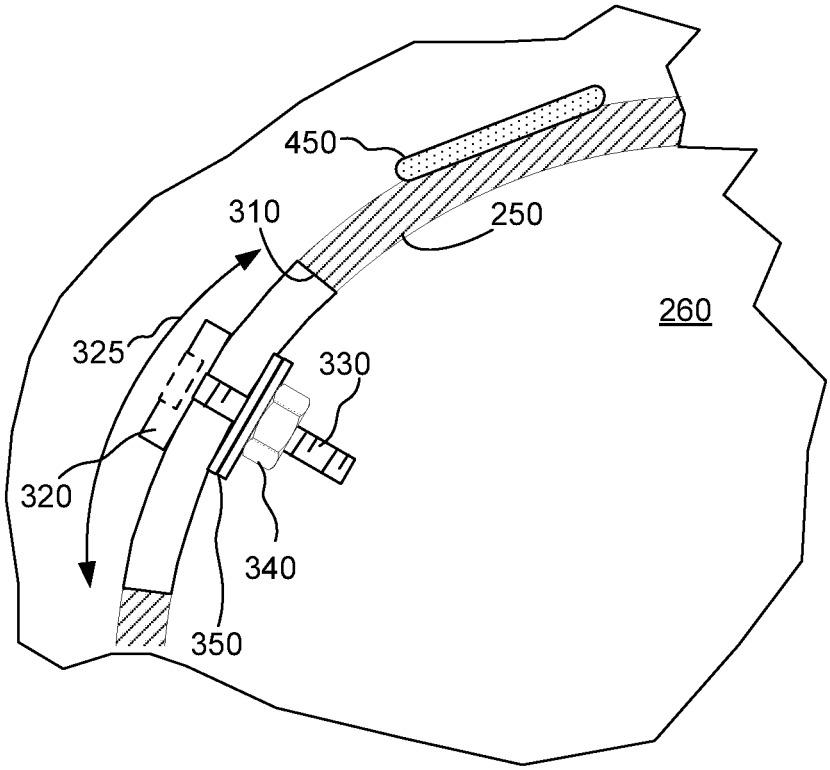
FIG. 10 is a fragmentary view, with parts removed for clarity, showing an exemplary one of the second magnets in operable condition to be moved manually rather than magnetically.

Referring to FIG. 10, it may be appreciated that first embodiment adjustment mechanism 490 need not be present. Rather, one or more second permanent magnets 320 may be moved manually rather than magnetically. To accomplish this result, nut 340 may be sufficiently tightened against interior surface 96 to prevent movement of second permanent magnet 320 in slot 310. When it is desired to relocate second magnet 320 in slot 310, nut 340 is loosened, second permanent magnet 320 is relocated in slot 310 and nut 340 is again tightened interior surface 96 to fix second permanent magnet 320 at the new location. In addition, manual relocation of second permanent magnet 320 is useful if any of first embodiment adjustment mechanisms 490 should fail, become inoperable or otherwise malfunction.

Figure 11:
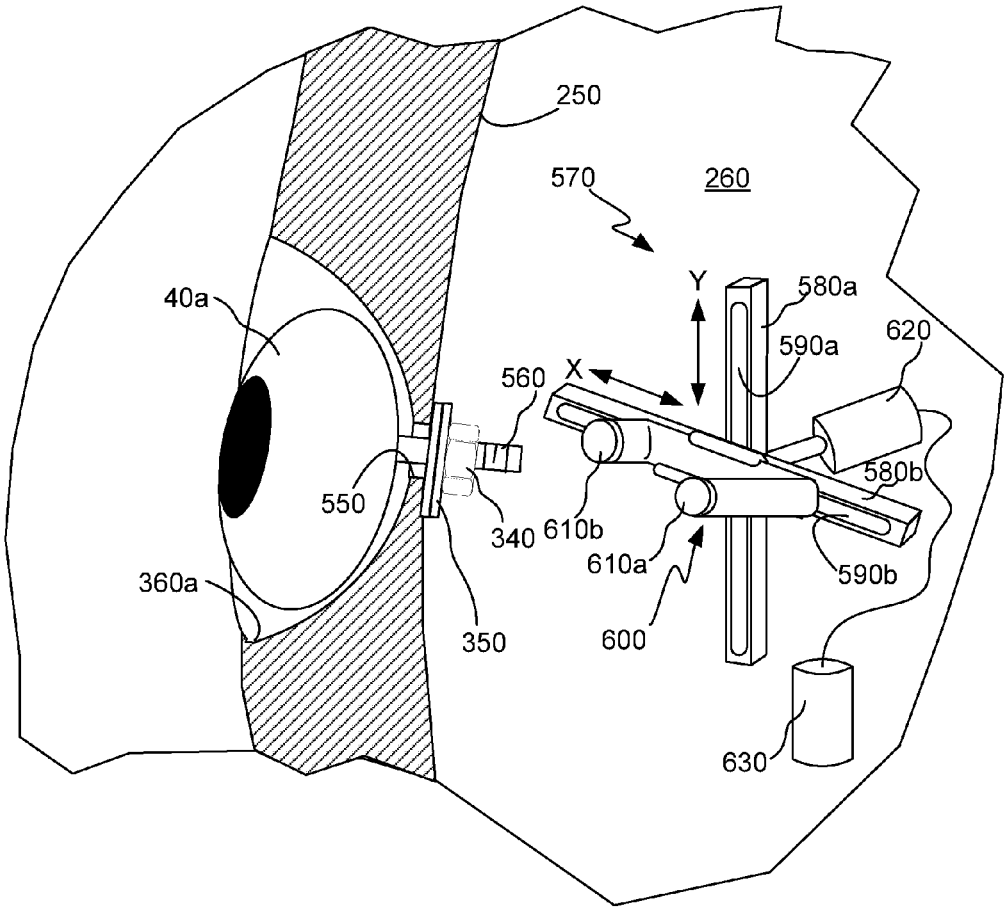
FIG. 11 is a fragmentary view, with parts removed for clarity, showing the eye element movably disposed in an eye socket defined by the face mask support, the eye element having a magnetically responsive portion thereof extending through a bore formed in the face mask support, the magnetically responsive portion being movable in the bore by means of the third embodiment adjustment mechanism that is operated by means of a motor powered by a battery.

As best seen in FIG. 11, each eye socket 360*a*/360*b* has a smooth bore 550 of predetermined width formed therethrough, so that eye sockets 360*a*/360*b* are in communication with cavity 470. Each of previously mentioned eye elements 40*a*/40*b* includes an integrally connected magnetically responsive portion, which is a metallic, externally threaded rod 560, that extends through bore 550. Rod 560 has a predetermined smaller transverse dimension than the predetermined width of bore 550, so that rod 560 is freely movable vertically and horizontally in bore 550. It may be appreciated that, as rod 560 moves vertically and horizontally, eye elements 40*a*/40*b* will move a like extent because rods 560 are integrally connected to their respective eye elements 40*a*/40*b*. Also, it may be appreciated that, if desired, a simulated eye lid (not shown) may be painted on an upper portion of each eye element 40*a*/40*b* or a covering (also not shown) may be attached to the upper portion of each eye element 40*a*/40*b*. Such a painted portion or covering will simulate at least partial closure of eye elements 40*a*/40*b* when eye elements 40*a*/40*b* are rotated or moved vertically downwardly due to movement of the magnetic field applied by second embodiment adjustment mechanism 570. Conversely, the unpainted or uncovered lower portion of each eye element 40*a*/40*b* can simulate opening of eye elements 40*a*/40*b* when eye elements 40*a*/40*b* are rotated or moved vertically upwardly due to movement of the magnetic field applied by second embodiment adjustment mechanism 570. Thus, eye elements 40*a*/40*b* can be opened and closed regardless of whether the doll is upright or reclined. Also, in this manner, eye elements 40*a*/40*b* are capable of winking.

Referring again to FIG. 11, internally threaded nut 340 is threadably received on rod 560 and tightened against interior surface 250 of first embodiment face mask support 230. However, nut 340 is not tightened to an extent that prevents vertical and horizontal movement of rod 560 in bore 550. Rather, nut 340 is tightened only to an extent that allows eye elements 40*a*/40*b* to be connected to first embodiment face mask support 230 while simultaneously allowing each eye element to vertically and horizontally move in bore 550. In this manner, eye elements 40*a*/40*b* will not become detached from first embodiment face mask support 230 as eye elements 40*a*/40*b* vertically and horizontally move in bore 550. In addition, if desired, at least one washer 350 may be interposed between nut 340 and interior surface 250 for evenly distributing pressure of nut 340 over the portion of interior surface 250 where nut 340 is located. Evenly distributing pressure of nut 340 over the portion of interior surface 250 where nut 340 is located prevents damage to interior surface 250.

Referring yet again to FIG. 11, disposed in cavity 470 is a second embodiment adjustment mechanism, generally referred to as 570, for magnetically moving the pair of eye elements 40*a*/40*b* vertically and horizontally. In this manner, eye elements 40*a*/40*b* may be moved vertically upwardly or vertically downwardly without reorienting the position of the doll that includes eye elements 40*a*/40*b*. In other words, the doll can remain substantially stationary while eye elements 40*a*/40*b* are controllably moved vertically and horizontally. In addition, as described momentarily, second embodiment adjustment mechanism 570 controls horizontally movement of eye elements 40*a*/40*b* to simulate following an object moving laterally, such as a person walking across a room.

Still referring to FIG. 11, the structure and functioning of second embodiment adjustment mechanism 570 will now be described. In this regard, second embodiment adjustment mechanism 570 includes an elongate first guide rail 580*a* and an elongate second guide rail 580*b* integrally connected to first guide rail 580*a*. Moreover, guide rails 580*a*/580*b* are oriented perpendicularly with respect to each other. A first groove 590*a* extends longitudinally along first guide rail 580*a* and a second groove 590*b* extends longitudinally along second guide rail 580*b*. Second guide rail 580*b* includes an integrally connected slider member (not shown) that is adapted to slidably engage first groove 590*a*, so that second guide rail 580*b* slidably translates in a "Y" direction (i.e., vertically), as shown. Slidably engaging second groove 590*b* is a carriage assembly, generally referred to as 600. Carriage assembly 600, which carries a pair of solenoids 610*a*/610*b*, slides in second groove 590*b* in an "X" direction (i.e., horizontally), as shown. A motor 620 is connected to second guide rail 580*b* for translating second guide rail 580*b* along first groove 590*a* in the "Y" direction. Motor 620 is also connected to carriage assembly 600 for translating carriage assembly 600 along second groove 590*b* in the "X" direction. Motor 620 translates second guide rail 580*b* and carriage assembly 600 by any convenient means, such as by a rack-and-pinion arrangement (not shown). Thus, second embodiment adjustment mechanism 570 is adapted to move solenoids 610*a*/610*b* bi-directionally, so that eye elements 40*a*/40*b* move bi-directionally (i.e., vertically and horizontally). Motor 620 is powered by a suitable power supply, such as by a battery 630. The battery 630 may be a disposable battery or a rechargeable battery. Battery 630 can be recharged by means of previously mentioned electrical wall outlet 540, if battery 630 is a rechargeable battery. In addition, battery 630 is connected to solenoids 610*a*/610*b* for electrically energizing solenoids 610*a*/610*b*.

Referring again to FIG. 11, each of solenoids 610*a*/610*b* will generate a magnetic field when solenoids 610*a*/610*b* are electrically energized. The magnetic fields generated by solenoids 610*a*/610*b* will act on respective ones of rods 560, such that, as carriage assembly 600 is moved either vertically and/or horizontally, rods 560 will move in bores 550 to a like extent because metal comprising rods 560 will respond to the magnetic field. Also, as previously mentioned, eye elements may be adapted to wink when an upper portion thereof is suitably painted or covered. Winking is accomplished by selectively energizing solenoids 610*a*/610*b*. As rods 560 move, eye elements 40*a*/40*b* will simultaneously move. In this manner, second embodiment adjustment mechanism 570 is adapted to controllably move eye elements 40*a*/40*b* in their corresponding eye sockets 360*a*/360*b*.

Returning to FIGS. 3, 4, 5 and 6, upper simulated gingival 490 belonging to previously mentioned jaw assembly 430 is adapted to pivot about pivot pin 525 for opening and closing jaw assembly 430. In this regard, a resilient member, such as a spring (not shown), may be interposed between upper simulated gingival 490 and lower simulated gingival 510 in a manner that closes jaw assembly 430 until jaw assembly 430 is acted upon by a magnetic field. The force of the magnetic field, which is generated by one of the first embodiment adjustment mechanisms 490 disposed near jaw assembly 430, is sufficiently strong to overcome the spring's tension in order to open jaw assembly 430 when desired. Alternatively, jaw assembly 430 may be mechanically operable by means of a spur gear 632, or other suitable means, that engages jaw assembly 430 to pivot upper simulated gingival 490. A reversible motor 635, that is powered by a battery 637, is connected to spur gear 632 for rotating spur gear 632 clockwise or counter-clockwise, so that upper gingival 490 can pivot to an open or closed position.

Figure 12:
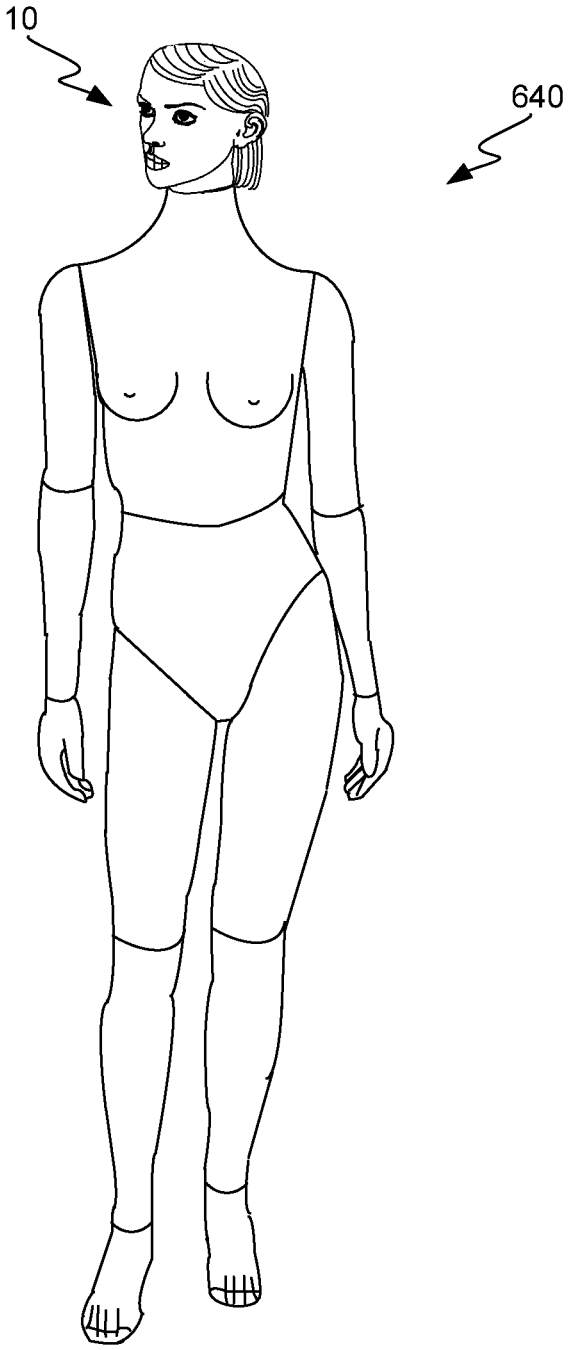
FIG. 12 is a view in perspective of the first embodiment doll head mounted on a mannequin's torso.

Referring to FIG. 12, first embodiment doll head 10 may be mounted atop a human-like, life-size doll torso, generally referred to as 640. First embodiment doll head 10 may be mounted atop doll torso 640 by any suitable means known in the art. Doll torso 640 in combination with first embodiment doll head 10 may serve as a mannequin for use in a commercial establishment, such as in a department store or at an amusement park. In a smaller size, doll torso 640 in combination with first embodiment doll head 10 can also serve as a child's toy. The controlled movement of facial features of first embodiment face mask 20 will increase the likelihood mannequin 640 will hold the interest of those individuals who view or use mannequin 640.

Figure 13:
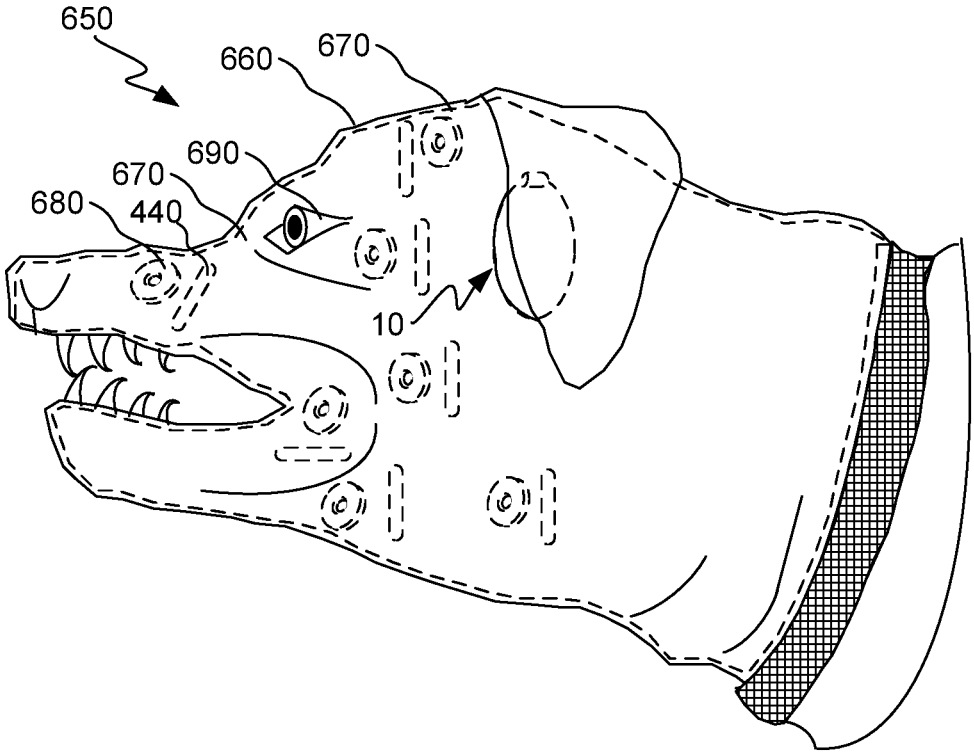
FIG. 13 is a view in perspective, with parts removed for clarity, of a second embodiment doll head having an alternative face mask, the alternative face mask having a visage or facial contour of an animal.

Referring to FIG. 13, there is shown a second embodiment doll head, generally referred to as 650. Second embodiment doll head 650 simulates an animal, such as a dog. Second embodiment doll head 650 includes a second embodiment face mask 660 comprising a resilient or flexible outer covering of simulated animal skin. Second embodiment face mask 660 surrounds a rigid second embodiment face mask support 670 shown in phantom. Second embodiment face mask support 670 supports second embodiment face mask 660 thereon. Facial contour of second embodiment face mask 660 is changeable by means of movable permanent magnets 680, adjustment mechanisms (not shown), motors (not shown) and batteries (also not shown) substantially similar to that disclosed hereinabove with reference to first embodiment doll head 10. A pair of animal eye elements 690 are coupled to second embodiment face mask support 670 and operate in a manner substantially similar to previously mentioned human-like eye elements 40*a*/40*b* of first embodiment doll head 10. Second embodiment doll head 650 further includes a hatch assembly, generally referred to as 700, for allowing access to an interior of second embodiment face mask support 670. Thus, in accordance with the teachings herein, the doll head is not only configurable as a simulated human head, but also configurable as an animal head, as well. Second embodiment doll head 650 is mountable on a simulated animal torso (not shown) by any suitable means. The simulated animal torso in combination with second embodiment doll head 650 may be used, for example, in a commercial establishment, such as in a pet store for purposes of advertising or at an amusement park. In a smaller size, the animal torso in combination with second embodiment doll head 650 can also serve, for example, as a child's toy.

Figure 14:
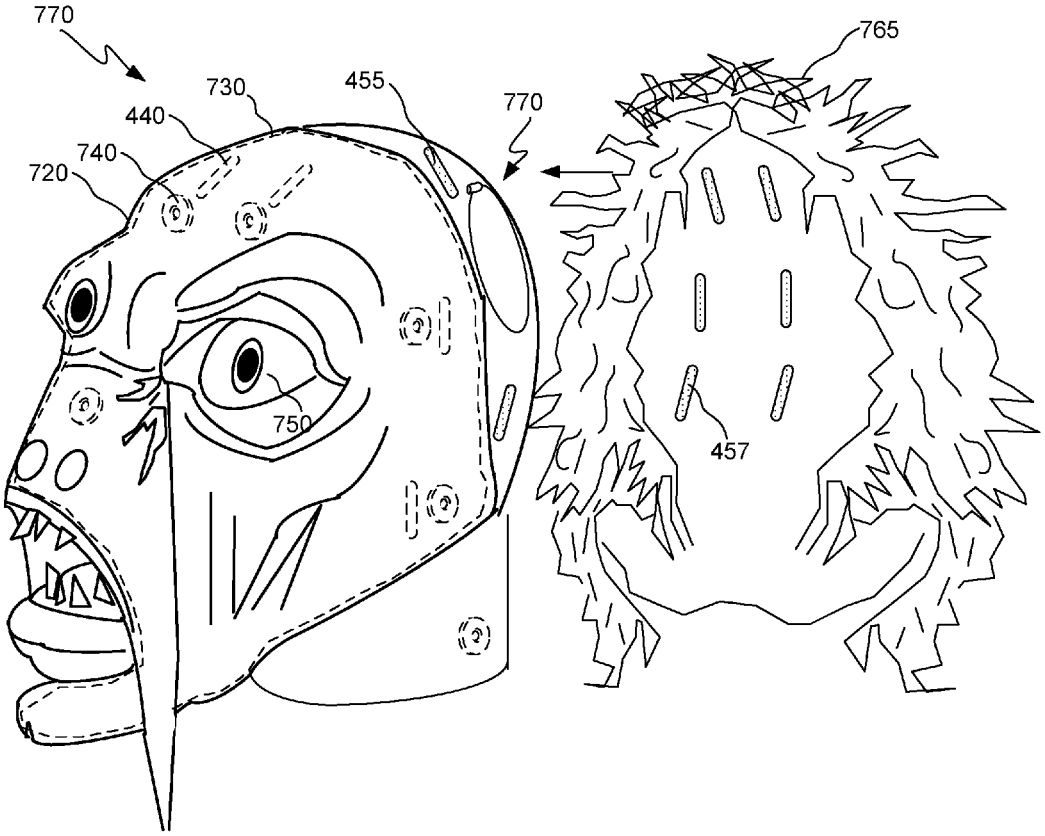
FIG. 14 is a view in perspective, with parts removed for clarity, of a third embodiment doll head having an alternative face mask, the alternative face mask having a visage or facial contour of an imaginary fanciful creature.

Turning now to FIG. 14, there is shown a third embodiment doll head, generally referred to as 710. Third embodiment doll head 710 simulates an imaginary fanciful creature, such as a space alien. Third embodiment doll head 710 includes a third embodiment face mask 720 comprising a resilient or flexible outer covering that simulates imaginary alien skin. Third embodiment face mask 720 surrounds a rigid third embodiment face mask support 730 shown in phantom. Third embodiment face mask support 730 supports third embodiment face mask 720 thereon. Facial contour of third embodiment face mask 720 is changeable by means of movable permanent magnets 740, adjustment mechanisms (not shown), motors (not shown) and batteries (also not shown) substantially similar to that disclosed hereinabove with reference to first embodiment doll head 10. A pair of alien eye elements 750 are coupled to third embodiment face mask support 730 and operate in a manner substantially similar to previously mentioned human-like eye elements 40*a*/40*b* of first embodiment doll head 10. Third embodiment doll head 710 further includes a hatch assembly, generally referred to as 760, for allowing access to an interior of third embodiment face mask support 730. A wig 765 may be connected to third embodiment face mask support 730, if desired, to simulate imaginary alien hair. Thus, in accordance with the teachings herein, the doll head is not only configurable as a simulated human or animal head, but also configurable as a head of an imaginary or fanciful creature, as well. Third embodiment doll head 710 is mountable on a simulated torso (not shown) of the imaginary or fanciful creature by any suitable means. The simulated torso of the imaginary or fanciful creature in combination with third embodiment doll head 710 may be used, for example, in an entertainment venue, such as in a live theater performance, cinematic production or at an amusement park. In a smaller size, the simulated torso of the imaginary or fanciful creature in combination with third embodiment doll head 710 can also serve, for example, as a child's toy.

Illustrative Methods

An illustrative method associated with exemplary embodiments for a doll head having a magnetically adjustable facial contour and method of assembling same will now be described.

Figure 15:
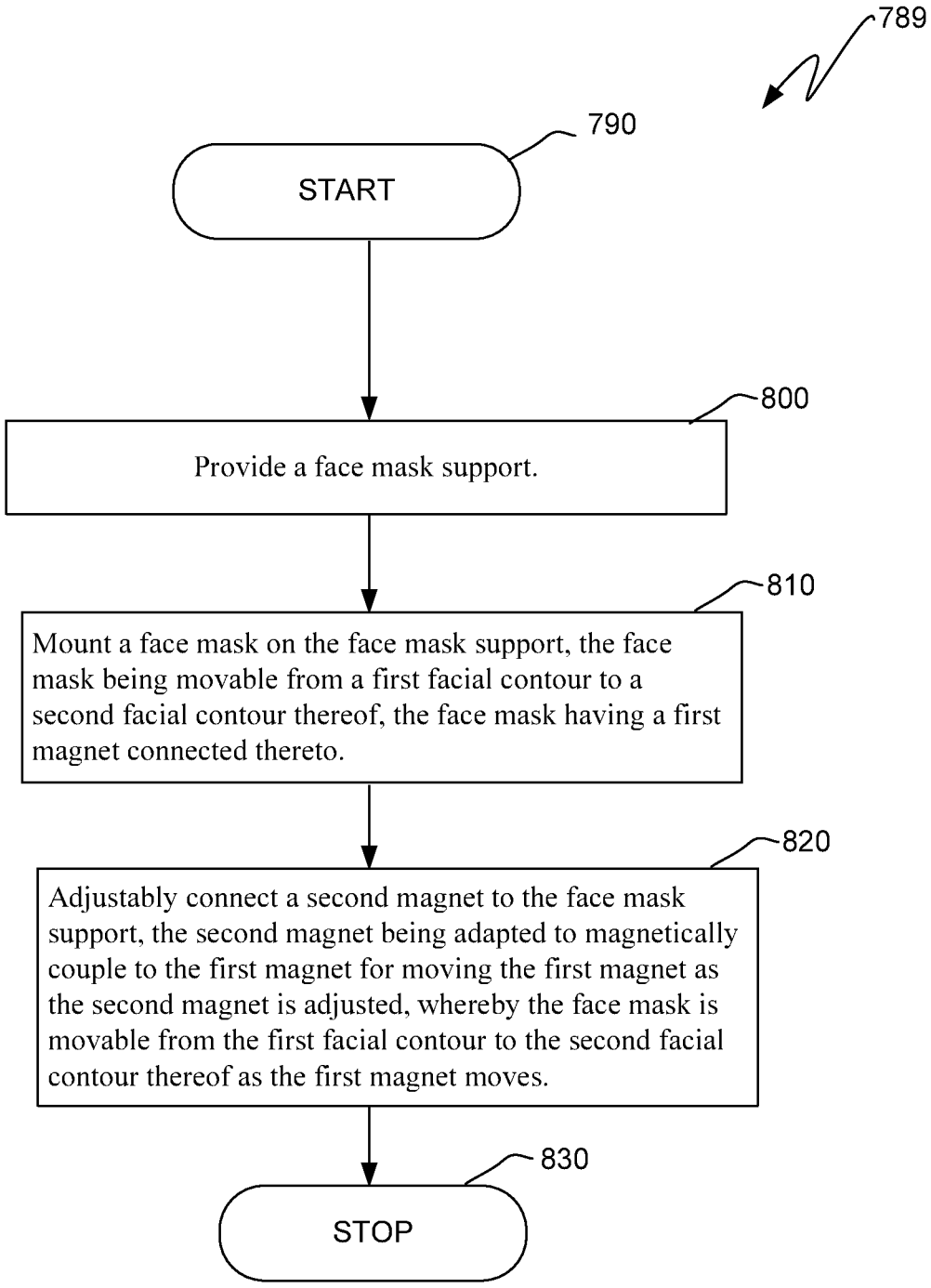
FIG. 15 is a flowchart of an illustrative method of assembling a doll head having a magnetically adjustable facial contour.

Referring to FIG. 15, an illustrative method 780 that is provided for assembling a doll head having a magnetically adjustable facial contour starts at a block 790. At a block 800, a face mask support is provided. At a block 810, a face mask is mounted on the face mask support, the face mask being movable from a first facial contour to a second facial contour thereof, the face mask having a first magnet connected thereto. At a block 820, a second magnet is adjustably connected to the face mask support, the second magnet being adapted to magnetically couple to the first magnet for moving the first magnet as the second magnet is adjusted, whereby the face mask is movable from the first facial contour to the second facial contour thereof as the first magnet moves. The method stops at a block 830.

It should be appreciated from the teachings herein that first embodiment 10, second embodiment 760 and third embodiment 710 of the doll head provide the user thereof an option for changing the doll head's appearance by not only exchanging one face mask for another; but, also changing the facial contour of a particular face mask by magnetic means. In addition, it may be appreciated from the teachings herein that eye elements 40*a*/40*b* can be configured to open and close regardless of whether the doll is upright or reclined. Also, eye elements 40*a*/40*b* can be configured to wink because eye elements 40*a*/40*b* are independently operable by separate operation of solenoids 610*a*/610*b*.

Other modifications and implementations will occur to those skilled in the art without departing from the spirit and the scope of the invention as claimed. For example, the controller (not shown) mentioned hereinabove and the electric motors 530 and 635 may be configured to communicate with each other by means of radio frequency waves rather than being directly connected to each other by means of one or more electrical wires. As another example, an audio device may be disposed within the doll head for annunciating prerecorded messages, such as commercial advertisements spoken to a pedestrian as the pedestrian walks by the doll head. Alternatively, such a prerecorded message may be a noncommercial message of interest to a child at play. Accordingly, the description hereinabove is not intended to limit the invention, except as indicated in the following claims.

What is claimed is:

1. A doll head having a magnetically adjustable facial contour, the doll head comprising:

a face mask support;

a face mask mountable on the face mask support;

a first magnet connectable to the face mask; and a second magnet connectable to the face mask support, the second magnet being adjustable over a range of positions and configured to magnetically couple with the first magnet, whereby adjusting the second magnet from a first position of the range to a second position of the range causes the first magnet to move therewith, thereby causing movement of at least a portion of the face mask to which the first magnet is connected, and thereby alters the facial contour of the face mask from a first facial contour of the face mask to a second facial contour of the face mask.

2. The doll head of claim 1, further comprising an adjustment mechanism coupled to the second magnet for adjusting the second magnet over the range of positions.

3. The doll head of claim 2, further comprising a motor connectable to the adjustment mechanism for operating the adjustment mechanism.

4. The doll head of claim 3, further comprising a power supply connectable to the motor and the adjustment mechanism for supplying power to the motor and the adjustment mechanism.

5. The doll head of claim 1, wherein the face mask support defines a slot therethrough sized to slidably receive the second magnet for slidably adjusting the second magnet.

6. The doll head of claim 1, further comprising an eye element movably connected to the face mask support.

7. The doll head of claim 6, wherein the eye element is magnetically movable.

8. A doll head having a magnetically adjustable facial contour, the doll head comprising:

a face mask support defining a cavity therein and at least one slot therethrough;

a face mask mounted on the face mask support, the face mask having an interior surface and an exterior surface defining a facial contour; and for each of the at least one slots:

a first magnet coupled to a guide means, the guide means received in the slot to guide the second magnet through a range of positions defined by the slot; and a first magnet affixed to the interior surface of the face mask, the first and second magnets configured to be magnetically coupled with one another, whereby adjusting the first magnet from a first position of the range to a second position of the range causes the second magnet to move therewith, thereby causing movement of at least a portion of the face mask to which the second magnet is connected, and thereby alters the facial contour of the face mask from a current facial contour to a different facial contour.

9. The doll head of claim 8, further comprising:

an adjustment mechanism magnetically coupled to the first magnet for adjusting the first magnet through the range of positions defined by the slot;

an electrically operable motor connected to the adjustment mechanism for electrically operating the adjustment mechanism; and an electrical power supply electrically connected to the electric motor and the adjustment mechanism for supplying electricity to the electric motor and the adjustment mechanism.

10. The doll head of claim 9, wherein the electrical power supply is a battery.

11. The doll head of claim 10, wherein the battery is a rechargeable battery.

12. The doll head of claim 8, wherein the face mask support defines an eye socket therein.

13. The doll head of claim 12, further comprising:

a movable eye element disposed in the eye socket, the eye element having a magnetically responsive portion; and a bi-directional adjustment mechanism magnetically coupled to the magnetically responsive portion of the eye element for moving the eye element bidirectioinally.

14. The doll head of claim 13, further comprising:

an electric motor connected to the bi-directional adjustment mechanism for electrically operating the bi-directional adjustment mechanism; and an electrical power supply electrically connected to the electric motor for supplying electricity to the electric motor.

15. The doll head of claim 14, wherein the electrical power supply is a battery.

16. The doll head of claim 15, wherein the battery is a rechargeable battery.

17. The doll head of claim 8, wherein the face mask support includes a hinged jaw assembly movable between an open position and a closed position.

18. The doll head of claim 17, wherein the jaw assembly is magnetically operable.

19. The doll head of claim 17, wherein the jaw assembly is mechanically operable.

20. A method of assembling a doll head having a magnetically adjustable facial contour, comprising:

providing a face mask support;

mounting a face mask on the face mask support, the face mask having an interior surface and an exterior surface defining a facial contour;

connecting a first magnet to the face mask;

connecting a second magnet to the face mask support, the second magnet being to adjustable through a range of positions and configured to magnetically couple with the first magnet, whereby adjusting the second magnet from a first position of the range to a second position of the range causes the first magnet to move therewith, thereby causing movement of at least a portion of the face mask to which the first magnet is connected, and thereby alters the facial contour of the face mask from a current facial contour to a different facial contour.

* * * * *